US011319650B2

(12) United States Patent
Corain

(10) Patent No.: US 11,319,650 B2
(45) Date of Patent: May 3, 2022

(54) WEFT THREAD CUTTING DEVICE LOOMS WITHOUT SHUTTLES

(71) Applicant: SANTEX RIMAR GROUP S.R.L., Trissino (IT)

(72) Inventor: Luciano Corain, Trissino (IT)

(73) Assignee: SANTEX RIMAR GROUP S.R.L., Trissino (IT)

( * ) Notice: Subject to any disclaimer, the term of this patent is extended or adjusted under 35 U.S.C. 154(b) by 0 days.

(21) Appl. No.: 17/253,274

(22) PCT Filed: Sep. 12, 2019

(86) PCT No.: PCT/IT2019/050202
§ 371 (c)(1),
(2) Date: Dec. 17, 2020

(87) PCT Pub. No.: WO2020/065685
PCT Pub. Date: Apr. 2, 2020

(65) Prior Publication Data

US 2021/0207300 A1 Jul. 8, 2021

(30) Foreign Application Priority Data

Sep. 27, 2018 (IT) ..... 102018000008980

(51) Int. Cl.
*D03D 49/70* (2006.01)
*D03D 47/12* (2006.01)
*D03D 47/00* (2006.01)

(52) U.S. Cl.
CPC ..... *D03D 49/70* (2013.01); *D03D 47/125* (2013.01)

(58) Field of Classification Search
CPC ..... D03D 49/70; D03D 47/125
See application file for complete search history.

(56) References Cited

U.S. PATENT DOCUMENTS 3,570,548 A * 3/1971 Golobart ..... D03D 47/00 139/453
4,040,452 A * 8/1977 Santucci ..... D03D 47/00 139/302

(Continued)

FOREIGN PATENT DOCUMENTS

CN 101387038 3/2009
CN 202144540 U 2/2012

(Continued)

OTHER PUBLICATIONS

International Search Report, issued in PCT/IT2019/050202, dated Jan. 24, 2020, Rijswijk, Netherlands.

(Continued)

*Primary Examiner* — Robert H Muromoto, Jr.
(74) *Attorney, Agent, or Firm* — Ferguson Case Orr Paterson

(57) ABSTRACT

A weft thread cutting device for shuttleless looms is placed between a fabric edge, a comb and a warp mouth, on one side, and a weft thread selector, on the other side. Weft threads, coming from a plurality of eyelets, join at a vertex located at the fabric edge and at the beating line of the comb. The weft thread cutting device has a rotating disk with a cutting edge, configured to cut the weft threads by a motor which keeps the rotating disk in rotation, and a step control motor, which, through a rotating shaft provided with an eccentric, controls motion of a hinged lever swinging with respect to a longitudinal axis of the step control motor. The hinged lever is shaped, at one end, in the form of two arms, respectively resting on the surfaces of two elastic plates, and is connected, at the other end, to the eccentric.

7 Claims, 5 Drawing Sheets

(56) References Cited

U.S. PATENT DOCUMENTS 4,054,159 A * 10/1977 Juillard ..... D03D 47/18 139/450
4,194,537 A * 3/1980 Hodr ..... D03D 47/26 139/194
4,600,039 A * 7/1986 Corain ..... D03D 47/48 139/434
4,749,006 A * 6/1988 Miyamoto ..... D03D 51/085 139/1 E
5,398,731 A * 3/1995 Schuster ..... B65H 59/22 139/194
5,398,732 A * 3/1995 Zenoni ..... B65H 59/22 139/194
6,155,309 A * 12/2000 Berktold ..... D03D 47/125 139/302
6,450,210 B2 * 9/2002 Schiller ..... D03D 49/70 139/302
7,584,769 B2 * 9/2009 D'Incau ..... D03D 47/271 139/448
10,221,508 B2 * 3/2019 Lampaert ..... D03D 47/125
2008/0105326 A1 * 5/2008 D' Incau ..... D03D 47/272 139/448

FOREIGN PATENT DOCUMENTS

CN 105177836 1/2017
CN 105765122 8/2019
EP 1020550 A1 7/2000

OTHER PUBLICATIONS

Written Opinion, issued in PCT/IT2019/050202, dated Jan. 24, 2020, Rijswijk, Netherlands.
Italian Search Report, issued in IT 2018000008980, dated Apr. 2, 2019.
Chinese Office Action, Issued in 201980043556.X , dated Jan. 19, 2022.

* cited by examiner

WEFT THREAD CUTTING DEVICE LOOMS WITHOUT SHUTTLES

CROSS-REFERENCE TO RELATED APPLICATIONS

This application is a National Phase Application of PCT International Application No. PCT/IT2019/050202, having an International Filing Date of Sep. 12, 2019 which claims the benefit of priority to Italian Patent Application No. 102018000008980, filed Sep. 27, 2018, each of which is hereby incorporated by reference in its entirety.

FIELD OF THE INVENTION

The present invention generally relates to a weft thread cutting device for shuttleless looms.

BACKGROUND OF THE INVENTION

Shuttleless looms technology (rapier looms, projectile looms, air-jet looms, water-jet looms) requires the presence of a warp cutting device at the shed inlet. The warp is inserted into the fabric and is taken from stocks constituted by feeding reels.

The rapier looms have wefts coming from feeding reels of different colors which reach the eyelets of the color selector and from said eyelets the wefts converge in a vertex located at the fabric edge and in correspondence with the beating line.

The weft cutting device, which is placed near said vertex, cuts the weft thread when the gripper takes the end of the weft and allows insertion of said weft thread in the warp mouth.

Weft cutting devices commonly used in rapier looms are of the type with distinct blades, configured to approach and cut the thread as a guillotine, of the scissors type or of the cutting disk type with high speed rotation.

The guillotine cutting device uses two sharp blades, which are spaced apart and come together for cutting. The blades are mounted on levers with feeler pins operated by a pair of rotating cams which cause movement of the blades.

The cutting elements are arranged in such a way as to intercept the selected weft, which is taken by the gripper, to cut the weft safeguarding wefts in stand-by and then to allow the weft inserted and pushed by the beating comb to go beyond the opened cutting blades, thus placing the weft next to the others waiting for another insertion.

The guillotine cutting blades require a high pressure between the cutting profiles when approaching for cutting, in particular when resilient technical yarns are used; this is a mechanical-textile critical aspect.

The scissors cut requires the scissors to be placed so as to intercept and cut the outgoing weft for making a new insertion without blocking re-entry of the weft just inserted, which involves moving several control devices and wire guiding devices. Moreover, the scissors cut requires high pressures between the cutting blades when resilient yarns are used.

Variations of the cutting phase, both using guillotine blades and scissors blades, are obtained by a variable regulation motor operated by an inverter, which must be properly dimensioned for controlling a set of mechanical devices having not negligible masses.

Cutting with a high-speed rotating blade is an effective solution for yarns with high resilience. However, said type of cutting is not suitable for fancy yarns or for a set of multiple wefts of different title and type, which make it difficult to change and control the cutting phase. In fact, said device cuts the thread pushed by the gripper against the rotating blade; therefore, cutting time is influenced by the physical features of the wire, even when the thread is previously retained by a mechanical element controlled with remote adjustments.

SUMMARY OF THE INVENTION

An object of the present invention is therefore to overcome the above drawbacks and, in particular, to provide a weft thread cutting device for shuttleless looms, adapted and used for standard yarns, fancy yarns, yarns of different title or high tenacity yarns.

Another object of the present invention is to provide a weft thread cutting device for shuttleless looms, which allows an easy selection of the weft threads to be inserted in the warp mouth.

A further object of the present invention is to provide a weft thread cutting device for shuttleless looms, which is positioned so as to minimize weft wastes constituted by the tails resting on the outer side of the false selvedge (which must be removed), with the possibility of varying the cutting phase for each weft by a remote device.

These and other objects are achieved by a weft thread cutting device for shuttleless looms, as described and claimed herein.

Advantageously, a highly reliable weft cut is obtained for each type of yarn, as well as considerable textile and mechanical efficiency and positive control of phase variation of the cutting by coupling a motor with a high speed rotating disk with a plurality of split taken feet and levers holding thread to be cut on both sides of the rotating disk. The device further comprises a retaining tooth that holds the weft before cutting, a pitch-controlled motor for operating a lever that presses the thread onto the taken feet at the sides of the rotating disk, lowers said feet to cut the tensioned thread between the two feet and rises to release the end of the thread taken from the inserting gripper and let the weft pushed by the beating comb re-enter between other wefts.

A control software for controlling the actuation motor of the control lever allows the cutting action of each weft thread to be timed with respect to the weft insertion cycle, while a proximity sensor placed on the control shaft of the weft control lever allows to obtain the phasing of the cut with respect to the operating cycle of the loom.

BRIEF DESCRIPTION OF THE DRAWINGS

Further objects and advantages of the present invention will become more apparent from the following detailed description, related to a preferred but not limitative embodiment of the weft thread cutting device for shuttleless looms, according to the present invention, and from the attached figures, in which.

DETAILED DESCRIPTION

Figure 1:
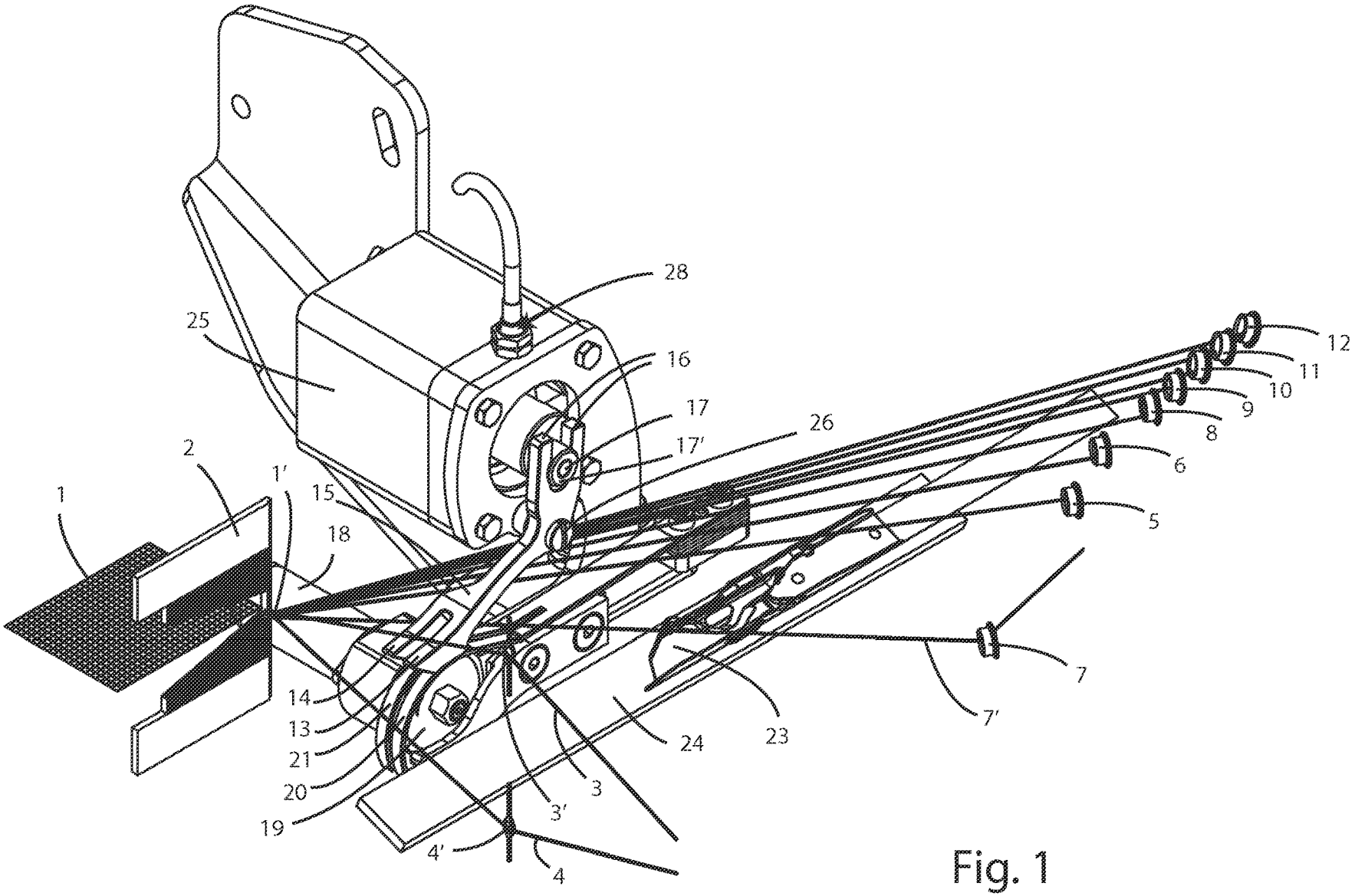
FIGS. 1 and 2 show two perspective views of the weft thread cutting device, according to the present invention, in two respective operating positions.

With reference to the figures, the weft thread cutting device is positioned between the fabric edge 1, the comb 2 and the warp mouth (formed by warp threads 3, 4 and respective thread guides 3', 4') on one side, while a color selector of several weft threads is placed on the other side, said selector being provided with a plurality of guide eyelets 5, 6, 7, 8, 9, 10, 11, 12 for guiding the threads.

In particular, the weft thread cutting device comprises two parts. A first part consists of a rotating disk 19 with a cutting edge for cutting the weft threads, driven by a motor 18 which keeps it in rotation, while a second part consists of a step control motor 25, which, through the rotation of its shaft 17, equipped with an eccentric 17', controls motion of a hinged lever 15 swinging with respect to a longitudinal axis 26.

The hinged lever 15 is shaped, at one end, in the form of two arms 13 and 14, which rest, respectively, on the surfaces of two elastic plates 20, 21, and, at the other end, has a U-shaped profile 16, inside of which one end of the eccentric 17' of the shaft 17 is inserted and is driven to rotate according to specific laws of motion caused by the operative cutting phases.

The step control motor 25 further comprises a proximity sensor 28 for detecting the position of the shaft 17 and of the lever 15 and a software interface for connecting one or more encoders of the loom, which is used for adjusting the cycle phases depending on the type of the weft.

The several weft threads coming from the eyelets 5, 6, 7, 8, 9, 10, 11, 12 of the color selector converge into a vertex 1' located at the fabric edge 1 and at the beating line of the comb 2 where the fabric is formed.

The weft thread cutting device according to the present invention operates as follows.

Figure 2:
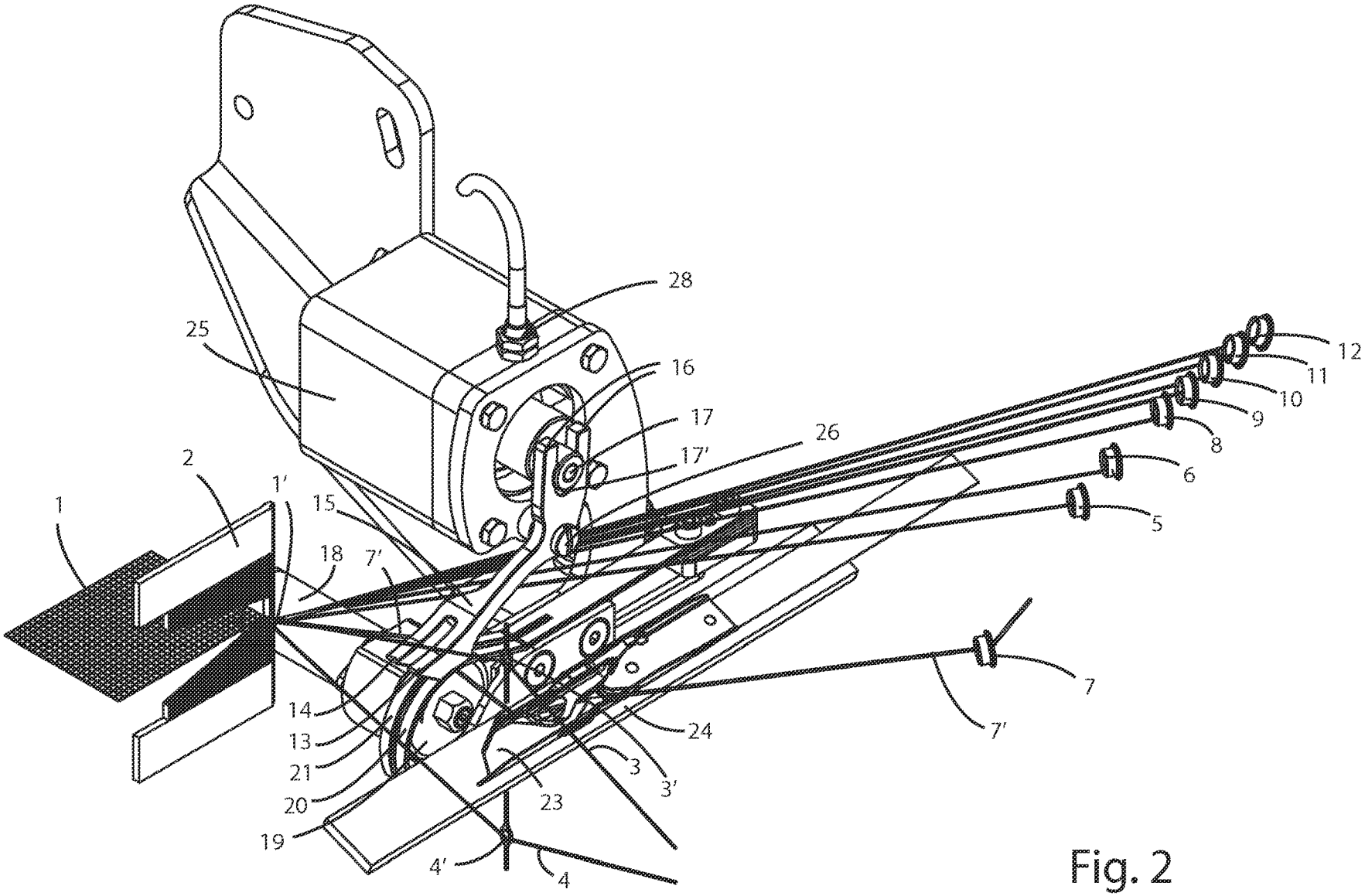
Figure 4:
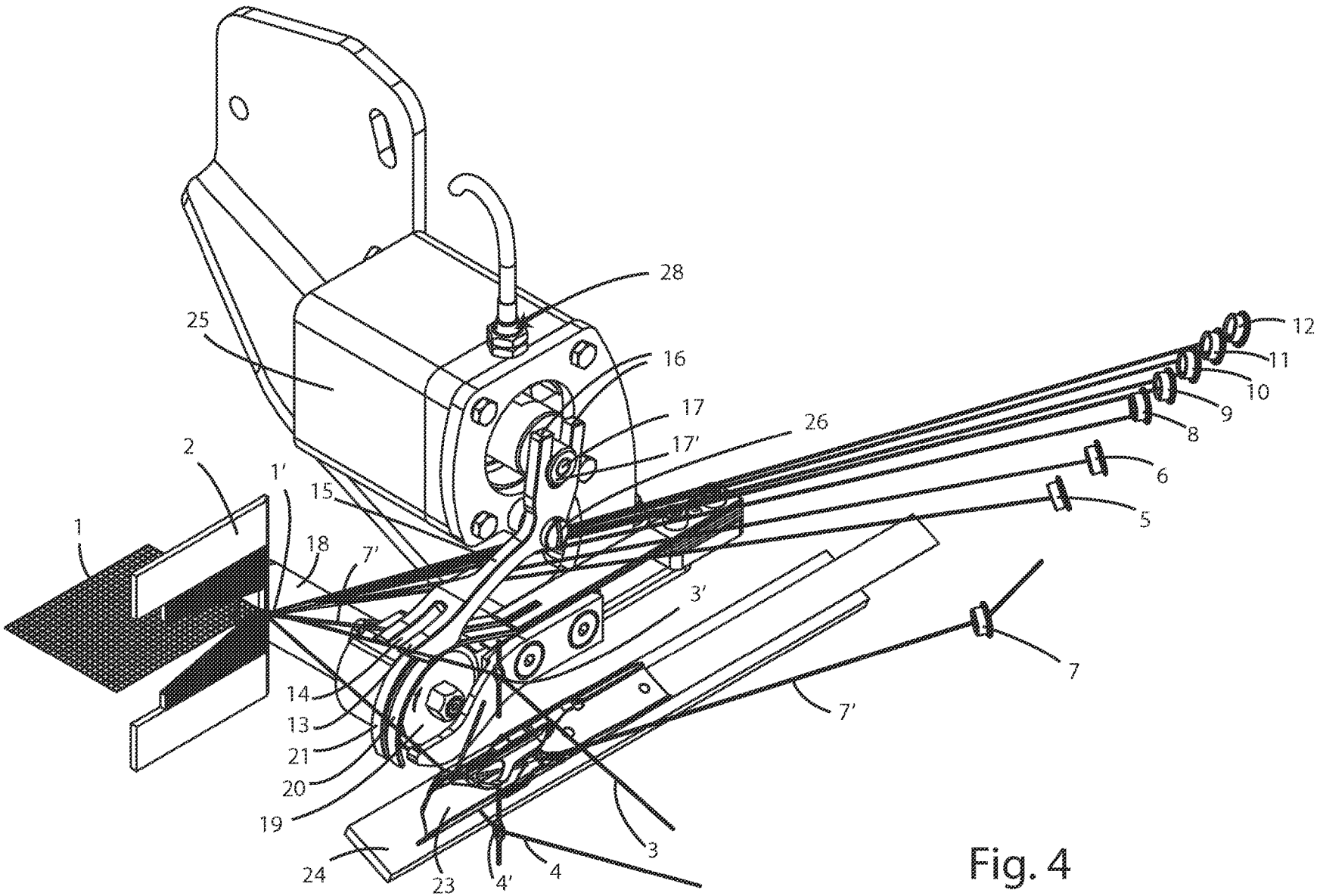
FIGS. 4 and 5 show two different perspective views of the weft thread cutting device, according to the present invention, in two respective operating positions.

The color selector lowers one of the weft threads, which is hooked at the vertex 1' on one side and which comes from a bobbin on the other side, by placing said thread from a stand-by position to a hand-over position, as clearly illustrated in FIGS. 1, 2 and 4 which show the movement of the weft thread 7'. The gripper 23, sliding on the guide 24, moves and grasps the weft thread 7', by pushing it between the elastic plates 20, 21 and the two arms 13, 14 of the hinged lever 15.

Figure 3:
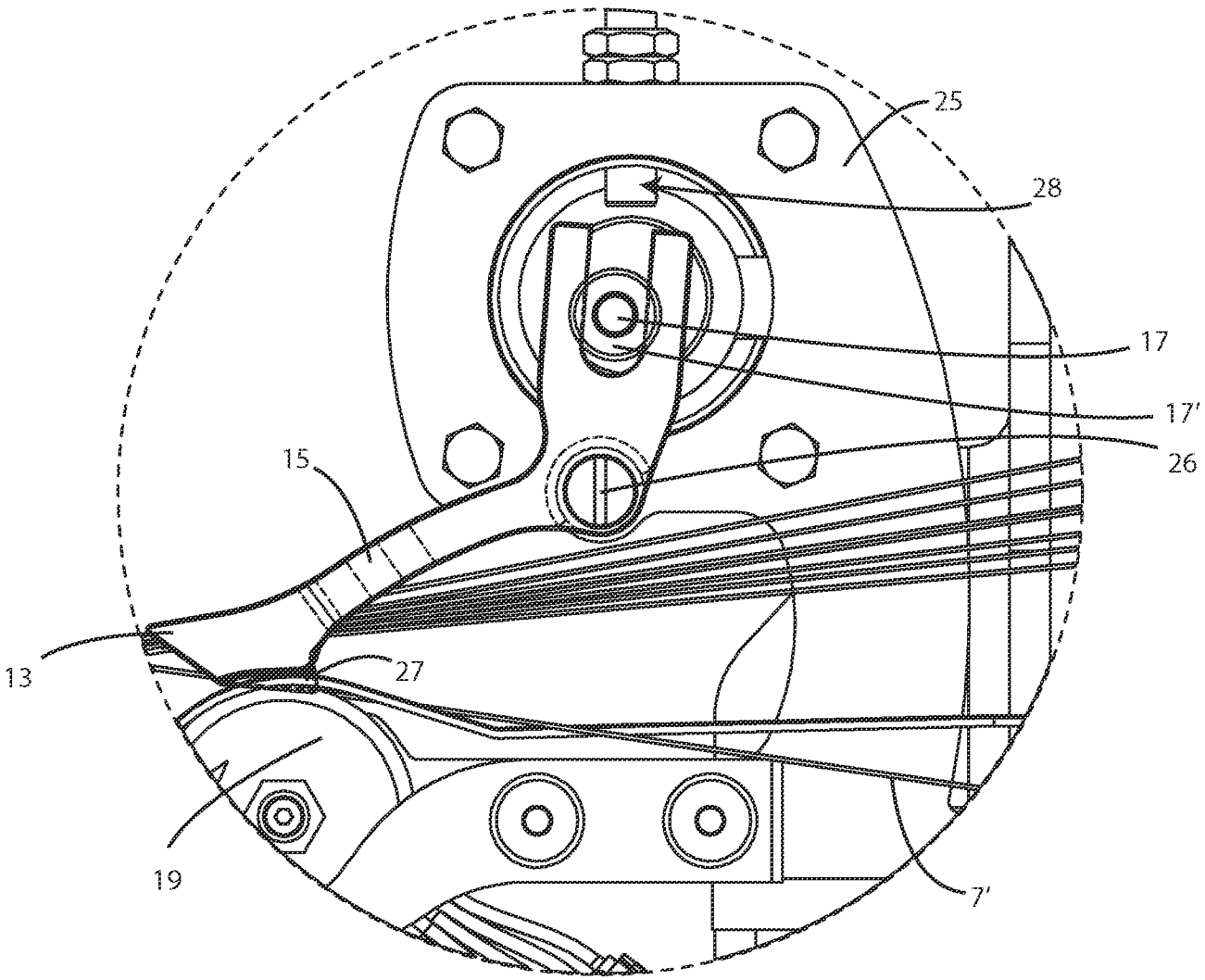
FIG. 3 is an enlarged detail view of the weft thread cutting device, according to the present invention.

As shown in FIG. 3, the weft thread 7' is held by the tooth 27 of the arm 14, on the side towards the fabric 1, near the rotating disk 19, before swinging of the lever 15. The lever 15, pushed by the eccentric 17' of the shaft 17, lowers the weft thread 7', which is clamped between the elastic plates 20, 21 and the arms 13, 14, at the two sides of the rotating disk 19, and cuts the weft thread by pushing the weft thread 7' between two gripping points close to each other and close to the cutting edge of the rotating disk 19, as shown in FIG. 4.

The step control motor 25 operates according to a software program, which causes swinging of the hinged lever 15 with programmable sequences and times, which are different depending on the color of the thread.

Figure 5:
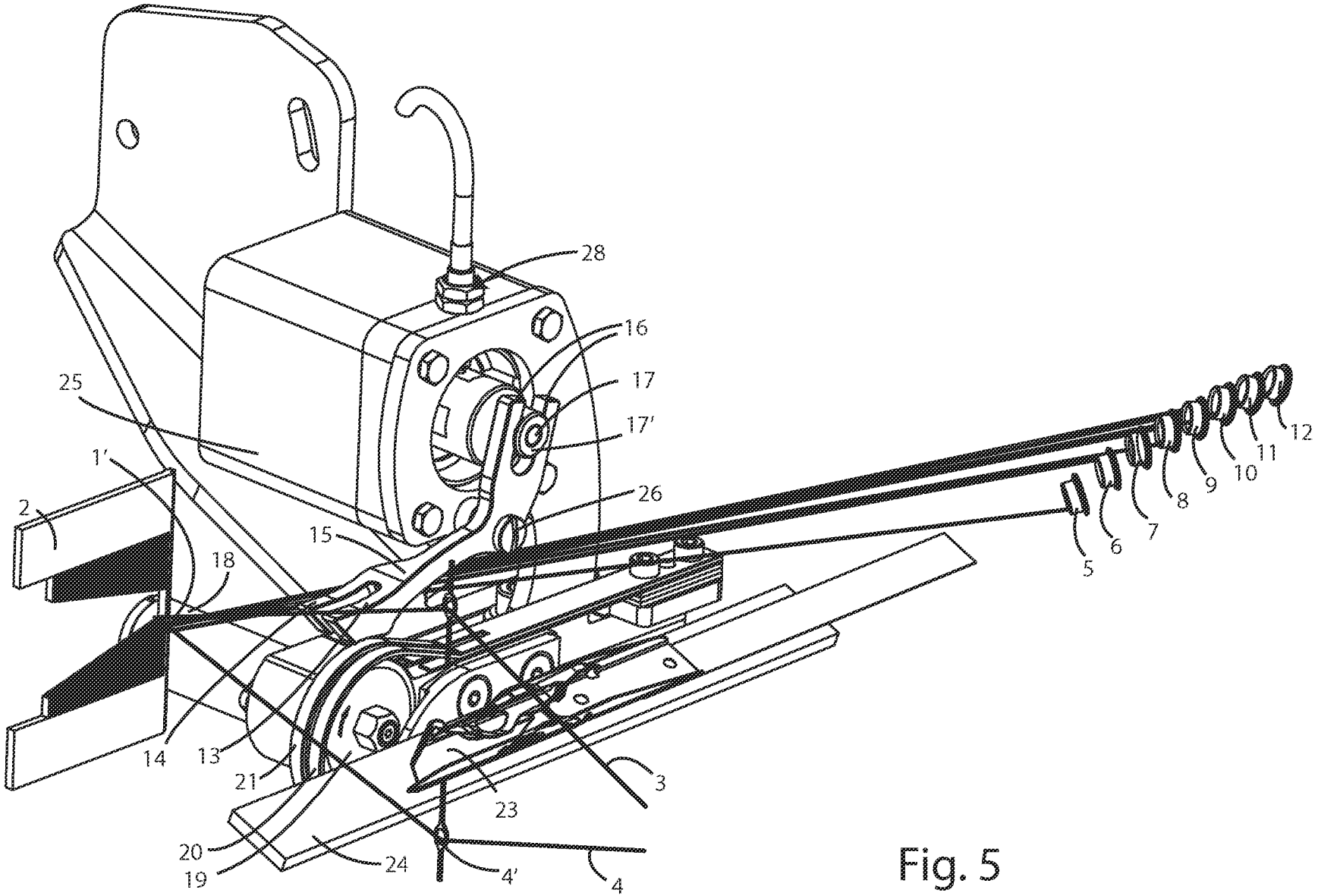

Once the weft thread 7' has been cut, the hinged lever 15 rises and consequently raises the arms 13, 14 from the surfaces of the elastic plates 20, 21. As shown in FIG. 5, the hinged lever 15 leaves the necessary space for re-entering of the weft thread just inserted and pushed by the beating comb 2. Finally, the hinged lever 15 returns to a position in which it contacts the elastic plates 20, 21, awaiting subsequent new cycles for inserting other weft threads.

The advantages of the cutting device of the present invention have thus been shown. Particularly, the cutting device uses as a cutting element a blade or a rotating disk effective for each type of threads, combined with an element able to place and mechanically grasp the thread at two points close together at the sides of the rotating disk, so as to push the thread against the cutting edge of the rotating disk and perform the cut at times which are set exclusively by the mechanical and electronic features of the device, without influences caused by the types of the thread, such as titles and types of yarns (fancy yarns, technical yarns, etc.).

The characteristics and advantages of the weft thread cutting device for shuttleless looms, object of the present invention, are thus clear from the above detailed description.

Finally, it is to be understood that many variants may be applied to the cutting device of the present invention, without thereby departing from the scope of protection as described and claimed herein.

The invention claimed is:

1. A weft thread cutting device for shuttleless looms, said weft thread cutting device being placed between a fabric edge, a comb and a warp mouth, on one side, and a weft thread selector, on the other side, said weft thread selector having a plurality of eyelets for guiding weft threads coming from said plurality of eyelets and joining at a vertex located at said fabric edge and at a beating line of said comb where fabric is formed, wherein said weft thread cutting device comprises a rotating disk having a cutting edge, configured to cut the weft threads by a motor which keeps the rotating disk in rotation, and a step control motor, which, through a rotating shaft provided with an eccentric, controls motion of a hinged lever configured to swing with respect to a longitudinal axis of said step control motor, said hinged lever being shaped, at one end, in the form of two arms, which rest respectively on surfaces of two elastic plates, said hinged lever being connected, at the other end, to said eccentric.

2. The weft thread cutting device of claim 1, wherein said step control motor comprises a proximity sensor for detecting position of said rotating shaft and of said hinged lever and a software program for controlling one or more encoders to command phases of a cutting cycle of the weft threads.

3. The weft thread cutting device of claim 1, wherein each weft thread is clamped by a gripper and pushed between said two elastic plates and said two arms of the hinged lever.

4. The weft thread cutting device of claim 1, wherein one arm of said two arms of the hinged lever, placed on a side towards the fabric, has a tooth which retains said weft thread next to said rotating disk until said hinged lever, swinging by means of said eccentric, lowers said weft thread, said weft thread being clamped between said two elastic plates and said two arms, at sides of the rotating disk.

5. The weft thread cutting device of claim 4, wherein said hinged lever causes a cutting of said weft thread by pushing said weft thread between two gripping points closed together and placed next to the cutting edge of said rotating disk.

6. The weft thread cutting device of claim 2, wherein said software program controls swinging of said hinged lever by programmed cycles and times different for each weft thread.

7. The weft thread cutting device of claim 1, wherein said hinged lever, after cutting the weft threads, raises said two arms from the surfaces of said two elastic plates, so as to leave a space for re-entering the weft thread which is inserted, and returns to a stand-by position waiting for subsequent cycles of insertion of the weft threads.

* * * * *